US007533844B2

(12) United States Patent
Mizutani et al.

(10) Patent No.: US 7,533,844 B2
(45) Date of Patent: May 19, 2009

(54) PAPER SPLICING APPARATUS

(75) Inventors: Hideki Mizutani, Hiroshima-ken (JP); Yoshio Harada, Hiroshima-ken (JP); Takayuki Miyake, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 189 days.

(21) Appl. No.: 11/528,355

(22) Filed: Sep. 28, 2006

(65) Prior Publication Data

US 2007/0075179 A1 Apr. 5, 2007

(30) Foreign Application Priority Data

Sep. 30, 2005 (JP) ..... 2005-286421

(51) Int. Cl.
*B65H 19/18* (2006.01)

(52) U.S. Cl. ..... 242/555.4; 242/556; 156/504; 156/507

(58) Field of Classification Search ..... 242/555, 242/555.3, 555.4, 556; 156/504, 507
See application file for complete search history.

(56) References Cited

U.S. PATENT DOCUMENTS 4,169,752 A * 10/1979 Tokuno ..... 156/157
4,219,378 A 8/1980 Marschke
4,481,053 A 11/1984 Tokuno et al.
5,171,396 A 12/1992 Rank et al.
6,786,264 B1 9/2004 Torres Martinez
2005/0279461 A1* 12/2005 Adami ..... 156/502

* cited by examiner

*Primary Examiner*—Sang Kim
(74) *Attorney, Agent, or Firm*—Kanesaka Berner & Partners

(57) ABSTRACT

An object of the present invention is to provide a paper splicing apparatus that can improve workability of an operator and splicing accuracy at low cost with a simple construction.

Thus, a paper splicing apparatus that carries out paper splicing by sticking together a tip of a new web pulled out from a rolled web to an old web drawn out from another rolled web comprises a first reciprocating member provided to freely reciprocate in an approaching/departing direction to/from a surface of the old web, a second reciprocating member provided to freely reciprocate in the approaching/departing direction independently of the first reciprocating member, a first roller pivotally supported to freely rotate with respect to the first reciprocating member, and a second roller pivotally supported to freely rotate with respect to the second reciprocating member with the new web fastened between the first roller and the second roller.

7 Claims, 6 Drawing Sheets

PAPER SPLICING APPARATUS

BACKGROUND OF THE INVENTION (1) Field of the Invention

The present invention relates to a paper splicing apparatus suitably applied to a corrugating machine for manufacturing a corrugated cardboard sheet.

(2) Description of Related Art

Conventionally, corrugated cardboards have been widely used as a durable, lightweight, and inexpensive industrial packaging material for commodity. distribution. A corrugated cardboard is generally manufactured from a rolled web, that is, a liner rolled web used as a liner and a cored rolled web used as a flute by using a corrugating machine. A corrugating machine is a machine that processes the cored rolled web into a corrugated flute shape and forms a sheet-shaped corrugated cardboard sheet by sticking the liner rolled web to a corrugated flute tip, and a box-like corrugated cardboard is completed by providing processing such as printing and punching to the corrugated cardboard sheet formed in this manner.

The corrugating machine for manufacturing a corrugated cardboard sheet is provided with a splicer (paper splicing apparatus) for continuously feeding paper by splicing a plurality of rolls of web to enhance production efficiency. When a remaining amount of roll of the liner rolled web becomes small or a type of web should be changed, paper splicing is carried out by splicing a web (new web) tip of another new roll to the web (old web) being fed into the corrugating machine and cutting off an extra old web on the roll side from a splicing position by means of a splicer. This can eliminate a need for putting a new web into the corrugating machine so that the corrugating machine can be made to work continuously without stopping for long hours.

A splicer described in European Patent No. 0453727 is known as such a splicer. In European Patent No. 0453727, a construction of the splicer that splices a new web to an old web currently being fed is described in which the new web and the old web are spliced by sticking an adhesive tape to a start edge of the new web while the start edge is held between a clamp bar and a press roller and, after sliding the clamp bar and the press roller in an old web direction, crimping a sticking portion of the adhesive tape on the new web onto a pressure roller around which the old web is wound.

With the above construction, a new web can be pull out at a position where an adhesive tape can easily be stuck and paper splicing can be carried out by crimping onto the old web while a start edge of the new web pulled out of a roll is fixed.

Depending on material or storage conditions of a rolled web, a start edge of the web or a web on a roll surface may be damaged or deteriorate with a high water content during storage. Thus, in such paper splicing operation, an appropriate amount of start edge of a new web will be cut before using the new web. For example, when a roll is replaced and a new one is mounted on the splicer, preparation for paper splicing is performed by pulling out a new web of about one winding from the roll start, cutting it off, and sticking an adhesive tape to a new start edge.

The length of a start edge of the new web to be cut off depends on storage conditions of each rolled web and the like, and this operation is normally done manually by an operator. Thus, considering workability, an arrangement and construction of a machine is desired in which a space is reserved for doing operation of cutting a start edge of a new web and sticking an adhesive tape while a certain length of the new web is pulled out from the roll.

In this respect, using a technique described in European Patent No. 0453727, the clamp bar and press roller can be moved to any position apart from an old web when doing operation of cutting a new web or sticking an adhesive tape so that operation space can easily be reserved. European Patent No. 0453727 also discloses a construction, as shown in FIG. 6A, in which a plate is provided near the press roller as a guide for cutting a start edge and sticking an adhesive tape.

Here, in a splicer equipped with a press roller 31 and a clamp base 32 for gripping a new web 34 for paper splicing, a guide table 35 is provided on a side of the press roller 31 in a position apart from a pressure roller 37.

Also, a leaf 33 elastically in contact with the new web 34 is mounted on the clamp base 32. After an adhesive tape 36 is stuck on the new web 34 by an operator while it is gripped by the press roller 31 and the leaf 33, the new web 34 is transferred to a position in close vicinity to the pressure roller 37 to be spliced to an old web. With such a construction, when cutting the new web 34 or sticking the adhesive tape 36, the guide table 35 itself can be made to work as a workbench and operation can be done thereon using an edge part of the guide table 35 as a guide.

After the adhesive tape 36 is stuck, a start edge of the new web 34 must be crimped onto the pressure roller 37 while the start edge of the new web 34 on which the adhesive tape 36 is stuck is sandwiched between the press roller 31 and the leaf 33. However, due to restrictions of arrangement inside the splicer, the position of the adhesive tape 36 on the guide table 35 provided as a guide and that of the adhesive tape 36 to be actually crimped onto the pressure roller 37 may be different.

If, for example, as shown in FIG. 6B, the contact position of the press roller 31 and the pressure roller 37 is a top part of the press roller 31, that is, a top end of the press roller 31 and a bottom end of the pressure roller 37 are in contact when a central axis of the press roller 31 is positioned vertically below that of the pressure roller 37, the position of the adhesive tape 36 on a peripheral surface of the press roller 31 must be changed by rewinding the new web 34 from a state shown in FIG. 6A in which the adhesive tape 36 is stuck, complicating the operation.

According to the technique described in European Patent No. 0453727, a sticking portion of the adhesive tape 36 is moved manually or by using a motor to make the sticking portion of the adhesive tape 36 match a crimp position between the pressure roller and the press roller 31.

However, excellent workability cannot be attained by manually moving the sticking portion of the adhesive tape 36 and also consistent operation quality cannot be guaranteed. If, on the other hand, the sticking portion of the adhesive tape 36 is moved by using a motor, a motor apparatus and a construction for driving the motor apparatus become necessary, causing the device construction of the splicer to be complicated and costs to pile up.

The present invention has been developed in consideration of the above problem, and an object thereof is to provide a paper splicing apparatus that can improve workability and splicing accuracy of an operator at low cost with a simple construction.

SUMMARY OF THE INVENTION

To achieve the above object, a paper splicing apparatus according to the present invention is a paper splicing apparatus (for example, a splicer) that carries out paper splicing to feed paper continuously by sticking together a tip of a new web pulled out from a rolled web to an old web drawn out from another rolled web comprising a first reciprocating member (for example, a pivotal supporting part) provided to freely reciprocate in an approaching/departing direction to/from a surface of the old web, a second reciprocating member provided to freely reciprocate in the approaching/departing direction independently of the first reciprocating member, a first roller (for example, a splice roller) pivotally supported to freely rotate with respect to the first reciprocating member, and a second roller (for example, a clamp roller) pivotally supported to freely rotate with respect to the second reciprocating member with the new web fastened between the first roller and the second roller.

According to the above construction, preparations for paper splicing (for example, operation to pull out a new web) can be made in a position apart from a paper splicing position and the new web can be moved to the paper splicing position while new web is fastened between the first roller and the second roller without causing wrinkles, thus improving paper splicing accuracy.

Also, it is preferable to provide a rotating member (for example, a rail wheel) that is mounted securely on the first roller and has a rotation surface that rotates as the first roller rotates, and a member provided in rows (for example, a rail) that is in contact with the rotation surface of the rotating member and causes the rotating member to rotate as the first reciprocating member reciprocates.

In this case, a distance of movement of the new web when the member provided in rows causes the first roller to rotate is a distance corresponding to a predetermined magnitude of rotation of the first roller. That is, the member provided in rows preferably causes the first roller to rotate a predetermined amount corresponding to a distance by which the new web should be moved.

According to the above construction, if the first roller is reciprocated together with the first reciprocating member, the first roller rotates together with the rotating member and the new web sandwiched between the second roller and the first roller is rewound (or rolled out), and thus a tip position of the new web can be changed. Also, by using a reciprocating operation of the first roller for sticking the new web to the old web, the first-roller can automatically be caused to rotate by a predetermined amount and, at the same time, the tip position of the new web can also be caused to change automatically.

Furthermore, it is preferable to provide a brake member (for example, a brake) for constraining rotation of the rotating member with respect to the first reciprocating member.

According to the above construction, rotation due to inertia of the first roller caused to rotate by the member provided in rows can be restrained to avoid over-rotation. This makes a correspondence between the tip position of the new web positioned by an index member and that after rotation more accurate, improving paper splicing accuracy.

Also, it is preferable to provide a rotation detecting means for detecting an amount of rotation of the first roller by the member provided in rows and to constrain, by the brake member, rotation of the rotating member when the amount of rotation detected by the rotation detecting means becomes equal to or larger than a predetermined amount.

According to the above construction, rotation due to inertia of the first roller can be restrained more accurately, further improving paper splicing accuracy.

Also, it is preferable to arrange the member provided in rows more closely on the rolled web side of the fastened new web than a moving track of a central point related to reciprocation of the first roller.

That is, when the first reciprocating member is moving in the approaching direction of the pressure roller, the member provided in rows preferably causes the first roller to rotate in a direction to rewind the new web to the rolled web.

According to the above construction, if the first roller is caused to reciprocate together with the first reciprocating member, the tip position of the new web will be rewound to the rolled web side. Therefore, the new web can be pulled out to a position where an operator cuts the web easily and the tip of the new web after cutting the web can be rewound. Also, even when the new web is pulled out more than necessary for paper splicing operation, the paper splicing operation is not affected at all.

By changing the contact length of the member provided in rows with the rotation surface of the first roller, a rewinding amount can be changed. That is, after cutting the tip of the new web, the rewinding amount of the new web can be defined in advance so that an appropriate length is automatically set without manually adjusting the length appropriate for paper splicing.

BRIEF DESCRIPTION OF THE DRAWINGS

FIG. 2A and FIG. 2B are both sectional views showing a principal, construction of the present paper splicing apparatus, wherein FIG. 2A is an A-A sectional view of FIG. 1 and FIG. 2B is a B-B sectional view of FIG. 2A;

FIG. 3A, FIG. 3B, and FIG. 3C are all schematic side views for illustrating rewinding operation of a new web in the present paper splicing apparatus, wherein FIG. 3A shows a state in which the new web is pulled out, FIG. 3B shows a state in which the new web is being rewound, and FIG. 3C shows a state in which a tip of the new web is moved to a contact position of a splice roller and a pressure roller;

DESCRIPTION OF THE PREFERRED EMBODIMENTS

An embodiment of the present invention will be described below with reference to drawings.

Figure 1:
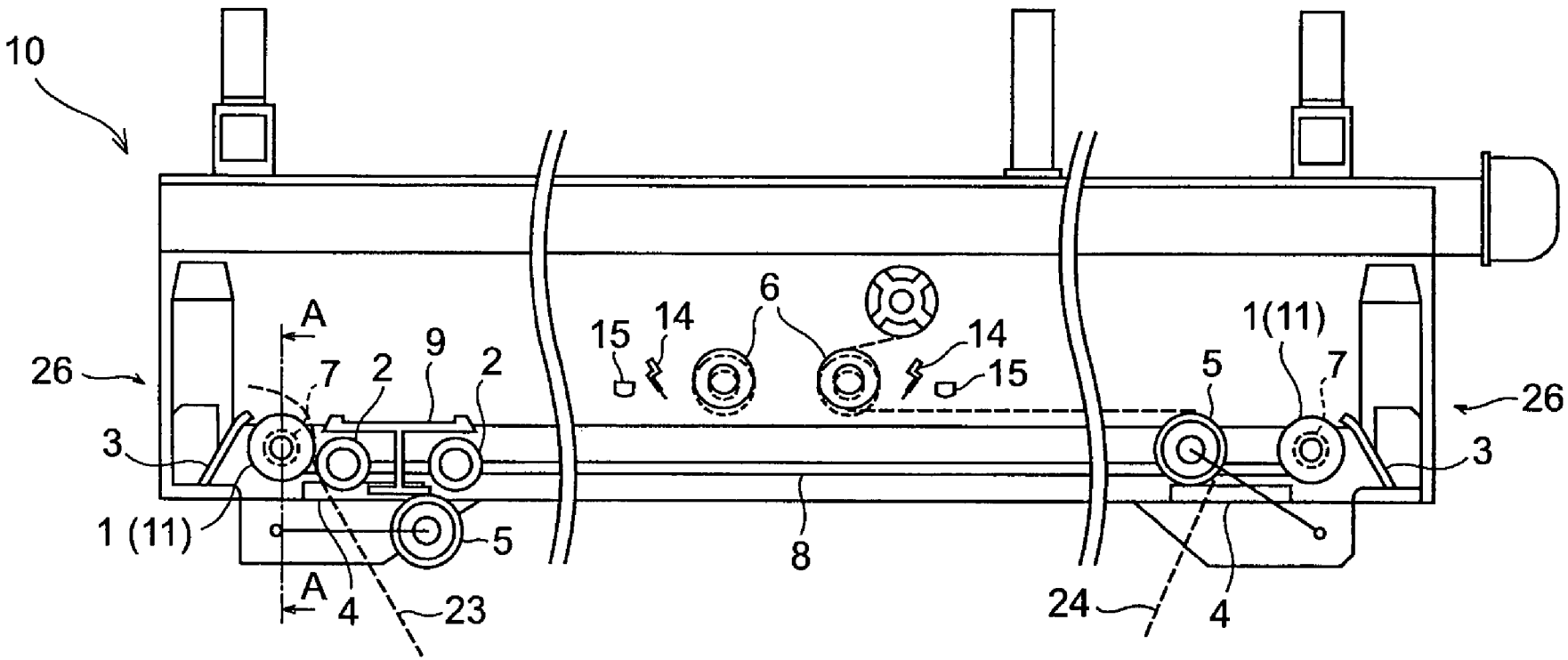
FIG. 1 is a side view showing an internal construction of a paper splicing apparatus as an embodiment, of the present invention.
Figure 3A:
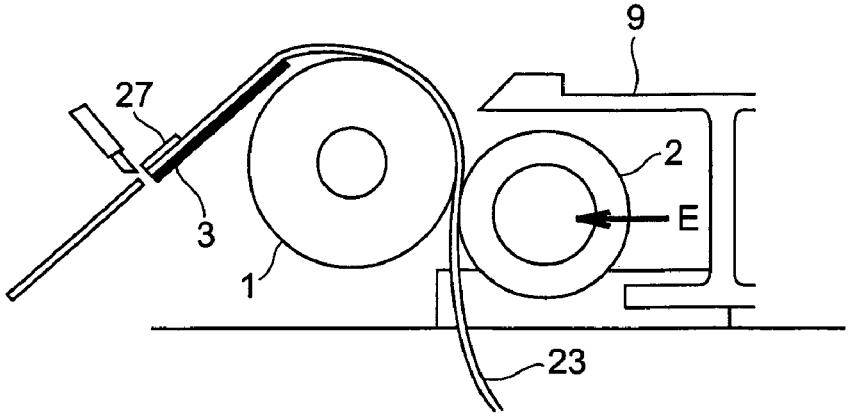
Figure 3B:
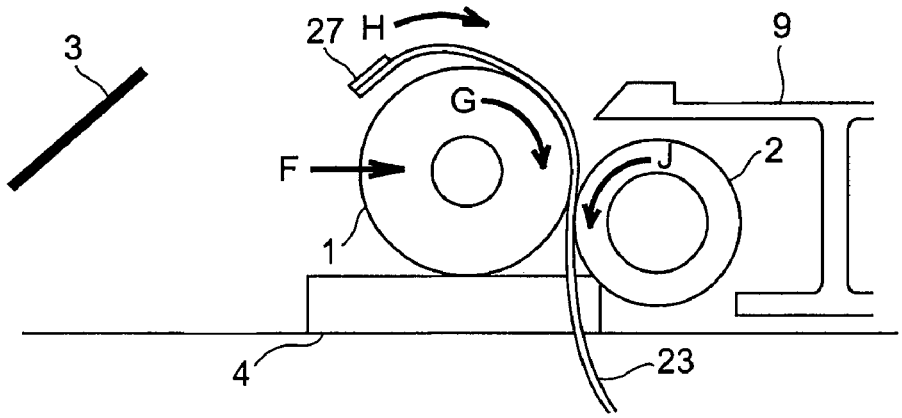
Figure 3C:
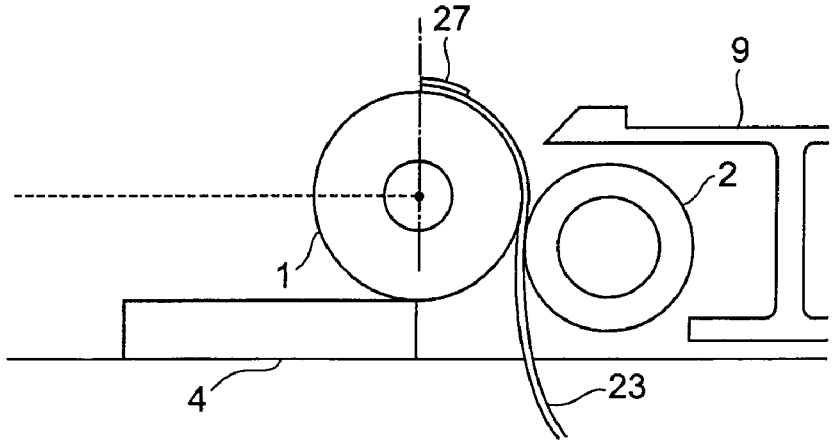
Figure 4A:
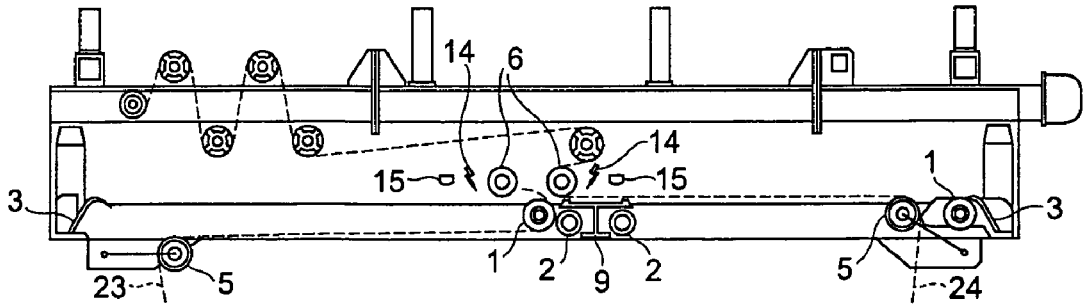
FIG. 4A, FIG. 4B, FIG. 4C and FIG. 4D are all schematic side views for illustrating paper splicing operation in the present paper splicing apparatus.
Figure 4B:
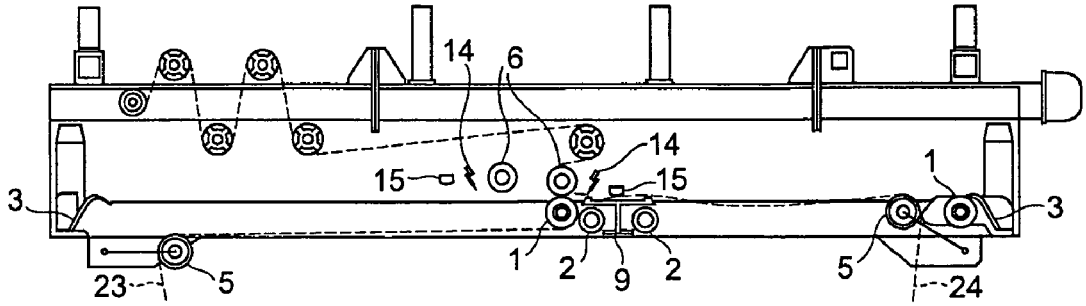
Figure 4C:
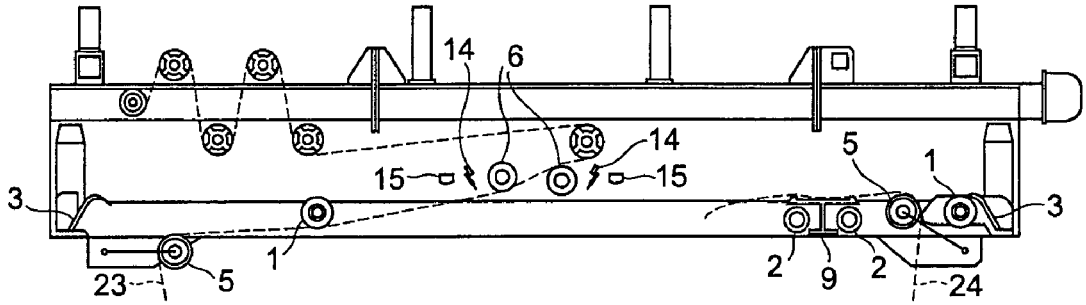
Figure 4D:
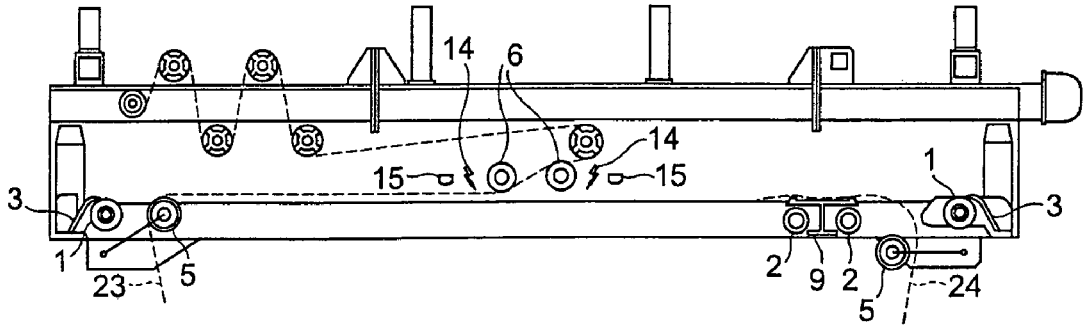
Figure 5:
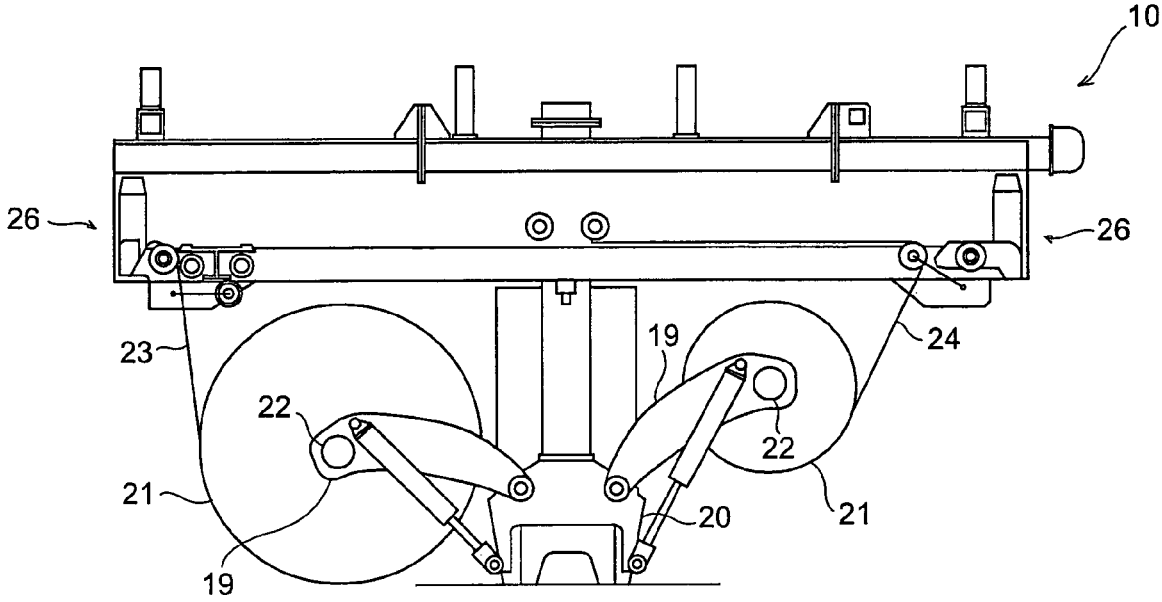
FIG. 5 is a side view showing a whole construction of the present paper splicing apparatus.
Figure 6A:
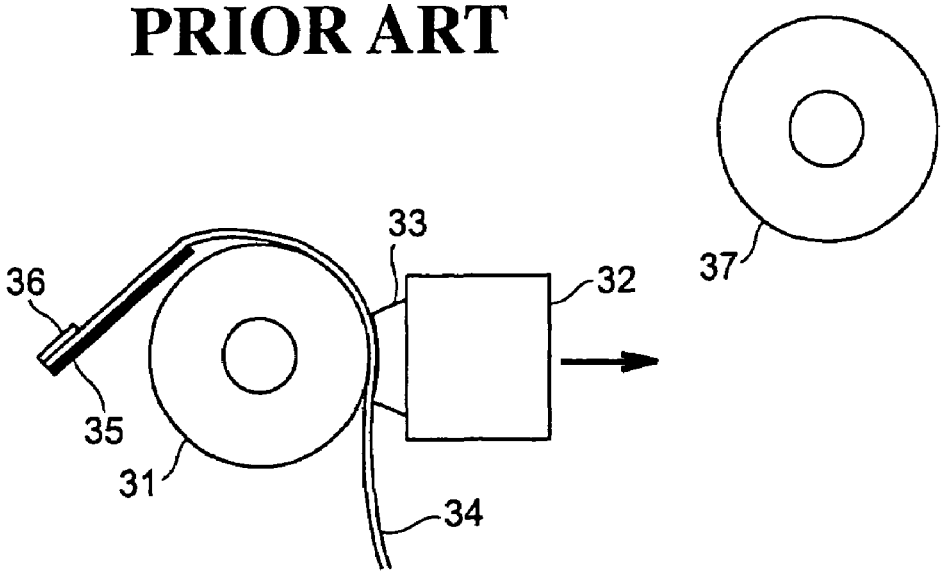
FIG. 6A PRIOR ART
FIG. 6A and FIG. 6B are both schematic side views for illustrating a conventional paper splicing apparatus.
Figure 6B:
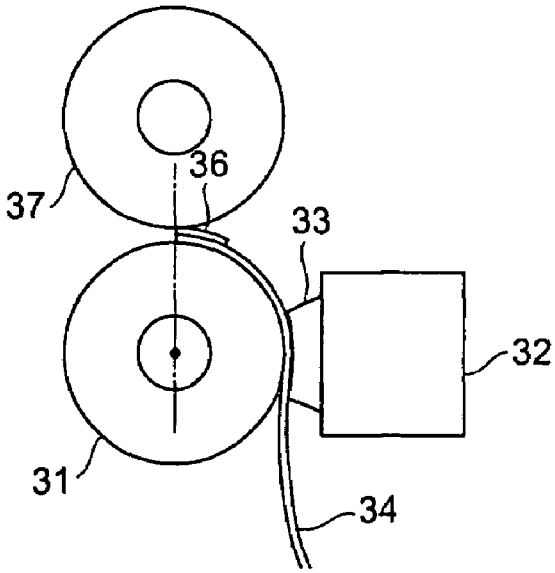
FIG. 6B PRIOR ART

FIG. 1 to FIG. 5 show a paper splicing apparatus as an embodiment of the present invention. FIG. 1 is a schematic diagram showing an internal construction of the present paper splicing apparatus, FIG. 2A and FIG. 2B are both sectional views showing the principal construction of the present paper splicing apparatus, FIG. 2A is an A-A sectional view of FIG. 1, FIG. 2B is a B-B sectional view of FIG. 2A, FIG. 3A to FIG. 3C are all schematic side views for illustrating rewinding operation of a new web in the present paper splicing apparatus, FIG. 4A to FIG. 4D are all schematic side views for illustrating paper splicing operation in the present paper splicing apparatus, and FIG. 5 is a side view showing the whole construction of the present paper splicing apparatus.

[Overall construction]

As shown in FIG. 5, a present splicer (paper splicing apparatus) 10 is arranged above a rolling stand 20 having a plurality of arms 19. An end of each of arms 19 is pivotally attached to the rolling stand 20 to freely swing in a vertical direction. A rolling core 22 that supports a rolled web 21 to freely rotate by pivotally attaching on the rolled web 21 is provided at another end of each of the arms 19.

The rolled-web 21 is set to the rolling core 22 by an operator and a start edge of the web is pulled out and then guided into the splicer 10. The web pulled out from the rolled web 21 is drawn out (paper fed) to various apparatuses such as a single facer and a corrugating machine (not shown) after passing through the splicer 10. Both end faces 26 in the figure of the splicer 10 are open to an outside of the splicer 10.

When the rolled web 21 that feeds the web is replaced or changed, paper splicing is carried out inside the splicer 10 by sticking a web (hereinafter referred to as a new web) 23 pulled out from one rolled web 21 to a web (hereinafter referred to as an old web) 24 drawn out from the other rolled web 21 so that paper can continuously be fed to various kinds of apparatus.

[Construction: inside the splicer 10]

FIG. 1 is a diagram schematically showing the internal construction of the splicer 10 in a state in which the old web 24 is drawn out and the new web 23 is about to be spliced. As shown in FIG. 1, the splicer 10 is comprised of a pair of splice rollers (first roller) 1, a pair of clamp rollers (second roller) 2, a pair of elevating rollers 5 and a pair of pressure rollers 6 as rotating members to transfer the web.

While the splicer 10 is operating, the old web 24 is wound around the peripheral surface of one of the pair of pressure rollers 6. Also, the pressure roller 6 is provided in such a way that it can slightly swing in the vertical direction in FIG. 1 and a swing of the pressure roller 6 in the vertical direction is controlled by an actuator (not shown). FIG. 1 shows a state in which the old web 24 is wound around the pressure roll 6 on the right side in the diagram.

Below the pressure roller 6, a frame 8 extending approximately horizontally in a longitudinal direction is fixed adjacent to the pressure roller 6. That is, the frame 8 is mounted extending in the departing direction to the right and left from an approaching position adjacent to the pressure rollers 6 respectively.

Above the frame 8, a pivotal supporting part (first reciprocating member) 7 and a clamp base (second reciprocating member) 9 are provided to freely reciprocate in the approaching/departing direction to/from the pressure roll 6 and each can independently reciprocate on the frame 8. That is, the pivotal supporting part 7 and the clamp base 9 are provided to freely reciprocate in the approaching/departing direction to/from the surface of the old web 24.

This reciprocation in FIG. 1 is a movement in the longitudinal direction. Drive controlling of reciprocation of the pivotal supporting part 7 and the clamp base 9 is performed by a motor and a control apparatus thereof (not shown).

The above-described splice roller 1 is pivotally supported to freely rotate with respect to the pivotal supporting part 7 and the clamp roller 2 is pivotally supported to freely rotate with respect to the clamp base 9.

The splicer 10 is constructed so that, while the pressure roller 6 is swung upward in FIG. 1 (position denoted by a solid line in FIG. 1) by the actuator (not shown), a predetermined gap is kept between the splice roller 1 and pressure roller 6 and they do not come into contact even if the splice roller 1 is moved in a direction that brings the splice roller 1 closer to the pressure roller 6. If, on the other hand, the pressure roller 6 is swung downward in FIG. 1 (position denoted by a middle broken line in FIG. 1), the splice roller 1 and pressure roller 6 could come in to contact if the central axis of the splice roller 1 is just vertically below that of the pressure roller 6. That is, the top end of the splice roller 1 (namely, the top part of the circular splice roller 1) and the bottom end of the pressure roller 6 (namely, a bottom of the circular pressure roller 6) could come into contact.

As shown in FIG. 1, a guide table (index member) 3 is securely attached to both ends of the frame 8. The guide table 3 is used as a workbench of the operator for cutting the new web 23 pulled out from the rolled web 21 or sticking an adhesive tape, and the new web 23 is cut using an edge of the guide table 3 as a guide and an adhesive tape is stuck to a start edge of the new web 23 cut on the guide table 3. The guide table 3 is securely attached to a position near enough to be reachable from both end faces 26 of the splicer 10 where operation to cut the new web 23 and stick a adhesive tape can easily be done.

The clamp roller 2 is a rotating member for fastening the new web 23 between the splice roller 1 and the clamp roller 2. The splice roller 1 and the clamp roller 2 are provided in such a way that the new web 23 while fastened between the two rollers 1,2 can slide in an extending direction of the frame 8 without causing wrinkles.

The elevating roller 5 is a rotating member for guiding the web drawn out from the rolled web 21 into the splicer 10 and is provided to freely swing in the vertical direction. FIG. 1 shows a state in which the elevating roller 5 on the right side is swung upward and the elevating roller 5 on the left side is swung downward. When the web is drawn out from the rolled web 21, one elevating roller 5 provided on the side of the drawn-out rolled web 21 is controlled to swing upward and the other elevating roller 5 is controlled to swing downward. The elevating roller 5 is also controlled to swing downward when no web is drawn out from the rolled web 21.

As shown in FIG. 1, cutters 14 for cutting the old web 24 and clippers 15 for pressing the old web 24 when cutting it are provided to the right and to the left of the pressure roller 6. They are apparatuses for cutting the old web 24 to which the new web 23 is stuck more closely to the roll 21 side than a sticking position thereof before or after a paper splicing process from the old web 23 to the new web 24. In the present embodiment, the cutters 14 and clippers 15 are each independently controlled to move in the vertical direction in FIG. 1.

[Construction: around the splice roller 1]

Figure 2A:
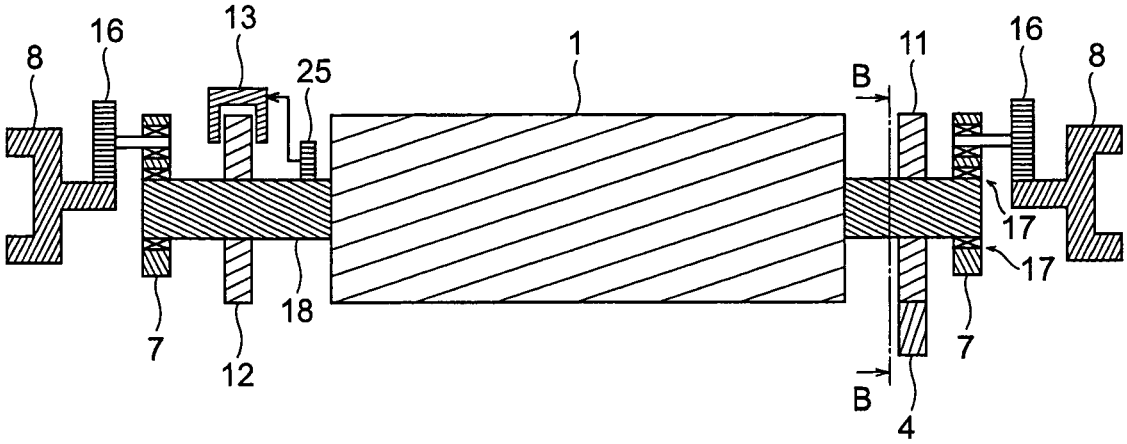

As shown in FIG. 2A, the pivotal supporting part 7 is provided to the right and to the left of the splice roller 1 respectively. Also, the splice roller 1 has an axis 18 installed through it supported by the pair of pivotal supporting parts 7 via bearings 17 respectively and is supported to freely rotate with respect to the pivotal supporting parts 7 using the axis 18 as a rotation axis. A frame wheel 16 running on the frame 8 is mounted on each pivotal supporting part 7 and rotational movement of these frame wheels 16 is together controlled by a control unit (not shown) so that both pivotal supporting parts 7 are driven to simultaneously reciprocate on the frame 8.

Also, a rail wheel (rotating member) 11 and a brake wheel 12 in a disk shape of the same diameter as that of the splice roller 1 are securely mounted on the axis 18. These rail wheel 11 and brake wheel 12 rotate integrally with the splice roller 1 and the axis 18.

Below the rail wheel 11, a rail 4 that could come into contact with a peripheral rotation surface of the rail wheel 11 arranged in rows adjacently to the frame 8 is securely mounted. As shown in FIG. 1, the rail 4 is mounted extending in parallel with the reciprocating direction of the pivotal supporting part 7. That is, the rail 4 is provided in parallel with the frame 8 in such a way that a peripheral rotation surface track of the rail wheel 11 when the pivotal supporting part 7 is moving in the reciprocating direction and a top end surface of the rail 4 match. The length L of the rail 4 is set, as shown in FIG. 2B, to be equal to a distance between the top end (top part) of the splice roller 1 and an outer edge of the guide table 3 when the pivotal supporting part 7 is moved up to an endmost part on the frame 8.

Figure 2B:
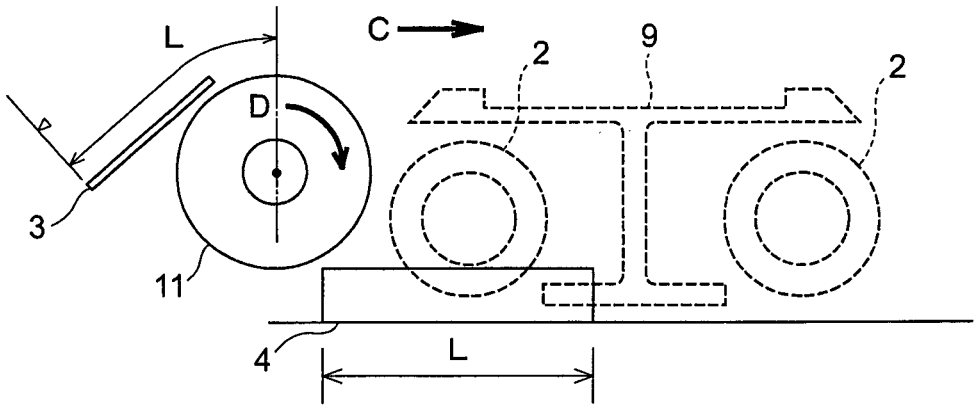

Accordingly, if the splice roller 1 moves in a pressure roller 6 direction (C direction in the figure) together with the pivotal supporting part 7 from a state shown in FIG. 2B, the rail 4 will rotate in a D direction in the figure while in contact with the rail wheel 11 and also the splice roller 1 will rotate simultaneously in the D direction. Consequently, if the new web 23 is fastened between the splice roller 1 and the clamp roller 2, the new web 23 will be rewound in the D direction in the figure as the splice roller 1 rotates, moving a start edge thereof up to the top end of the splice roller 1.

Above the brake wheel 12, a brake 13 is provided. Also, a rotary encoder (rotation detecting means) 25 for detecting an amount of rotation of the axis 18 is provided adjacent to the brake wheel 12. The amount of rotation detected here will be input into the brake 13.

These brake wheel 12 and brake 13 are brake members for constraining rotation of the splice roller 1 with respect to the pivotal supporting part 7. The brake 13 constrains rotation of the brake wheel 12 based on the amount of rotation of the axis 18 (that is, the amount of rotation of the splice roller 1) detected by the rotary encoder 25. More specifically, when the splice roller 1 moves in the C direction in FIG. 2B from the state shown in the figure and the splice roller 1 rotates in the D direction until a moving distance of a peripheral face of the splice roller 1 becomes equal to the length L of the rail 4, the brake 13 is set to constrain rotation of the brake wheel 12. In the present embodiment, a disk brake that gives a braking force to the brake wheel 12 by sandwiching both rotation surfaces of the brake wheel 12 between brake pads is used as the brake 13.

Accordingly, when the splice roller 1 and the clamp roller 2 move with the new web 23 fastened between them in the pressure roller 6 direction (C direction in the figure) from the state shown in FIG. 2B, a start edge of the new web 23 that has moved up to the top end of the splice roller 1 will move downward below the pressure roller 6 while the position thereof is sandwiched between the splice roller 1 and the clamp roller 2.

[Action: rewinding operation of the new web 23]

The present splicer 10 is constructed as described above and works as described below.

First, as a pre-arrangement to splice another web to the old web 24 already supplied inside the present splicer 10, a new rolled web 21 is attached to the rolling core 22 of the arms 19 on an unused side as the new web 23 by an operator. At this point, a control operation is performed to drive the frame wheel 16 to rotate by a motor (not shown) so that the splice roller 1 moves up to the endmost part on the frame 8.

Thereafter, the new web 23 of about one winding from a start edge of the rolled web 21 is pulled out by the operator and fastened between the splice roller 1 and the clamp roller 2.

At this point, as shown in FIG. 3A, the clamp roller 2 is controlled to be driven to the splice roller 1 side [E direction in FIG. 3A] while the new web 23 is pulled out longer than the outer edge (tip) of the guide table 3, which serves as a guide. This creates a state in which the new web 23 is gripped between the splice roller 1 and the clamp roller 2.

The pulled-out new web 23 is cut at the tip of the guide table 3 and a double-sided adhesive tape 27 is stuck to a start edge thereof.

Then, as shown in FIG. 3B, a control operation is performed to drive the frame wheel 16 to rotate while the new web 23 is fastened between the splice roller 1 and the clamp roller 2 so that the new web 23 moves on the frame 8 in the pressure roller 6 direction [F direction in FIG. 3B] together with the splice roller 1. Since, in this movement process, the top end surface of the rail 4 and the rail wheel 11 are in contact, the splice roller 1 rotates in the G direction in FIG. 3B with respect to the pivotal supporting part 7. With this rotation, the fastened new web 23 is rewound in the H direction in FIG. 3B, and at the same time, the clamp roller 2 rotates (forced to rotate) in the J direction in FIG. 3B.

The length L of the rail 4, that is, the contact distance between the rail 4 and the rail wheel 11 is set to be equal to a distance between the top end of the splice roller 1 and the outer edge of the guide table 3 while the pivotal supporting part 7 is moved up to an endmost part on the frame 8. Thus, as shown in FIG. 3C, the start edge of the new web 23 will be positioned at the top part of the splice roller 1 when a perpendicular line vertical to the rail 4 from the rotation axis of the splice roller 1 reaches the endmost part of the rail 4. That is, this is a state in which the tip of the new web 23 has moved to the contact position of the splice roller 1 and the pressure roller 6.

Furthermore, since, at this point, the rotary encoder 25 detects that the axis 18 has rotated in the D direction in the figure until the moving distance of the peripheral face of the splice roller 1 becomes equal to the length L of the rail 4, rotation of the brake wheel 12 is constrained by the brake 13. This makes it impossible for the splice roller 1 to rotate and the start edge of the new web 23 that has moved to the top part of the splice roller 1 will remain at a fixed position.

[Action: paper splicing operation]

Then, as shown in FIG. 4A, the central axis of the splice roller 1 is controlled to move until it is positioned vertically below the pressure roller 6 while the new web 23 is fastened between the splice roller 1 and the clamp roller 2. Then, the pressure roller 6 is driven to swing downward by the actuator (not shown) so that the bottom of the pressure roller 6 and the top part of the splice roller 1 are crimped. This carries out paper splicing by crimping the double sided adhesive tape 27 at the start edge of the new web 23 positioned at the top part of the splice roller 1 onto the old web 24 wound around the pressure roller 6.

Before or after paper splicing as described above, the clipper 15 is controlled to move downward in FIG. 4B, as shown in FIG. 4B, so that the old web 24 is fixed by being sandwiched between the clamp base 9 and the clipper 15 and the cutter 14 is similarly controlled to move downward to cut the extra old web 24 closer to the roll side than the splicing position.

After the paper splicing operation is completed, as shown in FIG. 4C, the clamp base 9 is controlled to move together with the clamp roller 2 to the side on which the old web 24 was supplied and the splice roller 1 is, on the other hand, controlled to move to the side on which the new web 23 is started to be supplied. Then, furthermore, as shown in FIG. 4D, the elevating roller 5 on the right side in the figure is controlled to swing downward to prepare the next paper splicing. Also, when the splice roller 1 controlled to move to the side on which the new web 23 is started to be supplied has moved to the endmost part on the frame 8, the elevating roller 5 on the left side in the figure is controlled to swing upward to complete a series of paper splicing operation.

[Effect]

Thus, according to the splicer 10 in the present embodiment, first the new web 23 is pulled out easily and operation such as cutting a start edge and sticking the double sided adhesive tape 27 can be done at a position adjacent to both end faces 26 of the splicer. The new web 23 can be moved in the pressure roller 6 direction without causing wrinkles on the surface of the new web 23 while the start edge of the new web 23 pulled out from the rolled web 21 is fastened between the splice roller 1 and the clamp roller 2. Furthermore, by rotating the rail wheel 11 on the rail 4 using such a movement operation of rollers, the splice roller 1 can be caused to rotate with respect to the pivotal supporting part 7. Consequently, the new web 23 fastened by the splice roller 1 can be rewound.

Since the clamp roller 2 that fastens the new web 23 between the splice roller 1 and the clamp roller 2 is provided to freely rotate with respect to the clamp base 9, the clamp roller 2 is also caused to rotate as the splice roller 1 rotates. Thus, the new web 23 can be rewound without exerting an excessive force. That is, the new web 23 can be rewound without twist and bending.

An amount of rewinding of the new web 23 is the length L of the rail 4, that is, as shown in FIG. 2B, the distance between the top end of the splice roller 1 and the outer edge of the guide table 3 when the pivotal supporting part 7 is moved up to the endmost part on the frame 8. Thus, when the splice roller 1 and the clamp roller 2 are moved in the pressure roller 6 direction, the start edge of the new web 23 cut by the outer edge of the guide table 3 can automatically be moved to the top part (contact position of the splice roller 1 and the pressure roller 6) of the splice roller 1.

Also, since the above embodiment is equipped with the brake 13, over-rotation due to inertia of the splice roller 1 caused to rotate by the rail 4 can be prevented. This is particularly effective when the splice roller 1 is massive. Thus, positioning accuracy of the start edge of the new web 23, that is, the correspondence between the position of a start edge of the new web 23 cut on the guide table 3 and that of the start edge on the splice roll 1 after the rotation becomes accurate, improving paper splicing accuracy.

[Others]

So far, an embodiment of the present invention has been described, but the present invention is not limited to this embodiment and can be embodied in various forms without departing from the spirit of the present invention.

In the above embodiment, as shown by a broken line in FIG. 3C, the rail 4 is provided below (that is, on the rolled web 21 side of the fastened new web 23) the moving track related to reciprocation of the central point of the splice roller 1, but if the rail 4 is provided above the moving track, to the contrary, the new web 23 can automatically be pulled out by a similar movement operation. That is, mapping between the position of a start edge during operation such as cutting the new web 23 or sticking the double sided adhesive tape 27 and that of the start edge during paper splicing thereafter can arbitrarily be set.

Also in the above embodiment, the length L of the rail 4 is set to be equal to the distance between the top end of the splice roller 1 and the outer edge of the guide-table 3, but by changing a radius of the rail wheel 11, for example, the length of the rail 4 that can cause the splice roller 1 to rotate the same amount can be changed.

Though, in the above embodiment, the rail wheel 11 rotates while it is in contact with the rail 4, a rack-and-pinion structure in which gears mesh with each other may also be adopted. In this case, the rail wheel 11 (as a result, the splice roller 1) can be rotated more reliably.

Also in the above embodiment, when braking the brake wheel 12 using the brake 13, the amount of rotation of the axis 18 (that is, the splice roller 1) is detected using the rotary encoder 25 and, when the splice roller 1 has rotated until the moving distance of the peripheral face of the splice roller 1 becomes equal to the length L of the rail 4, a braking force is given to the brake wheel 12. Thus, even if the rail 4 is made longer than the above embodiment, rotation of the splice roller 1 will be similarly constrained. That is, the length L of the rail 4 can be set arbitrarily longer than that of the above embodiment.

Or, shortening of the length of the rail 4 using inertia in the direction of rotation of the splice roller 1 can also be considered. For example, if inertia of the splice roller 1 is large enough, the length of the rail 4 may be such that an impulse of rotation of the splice roller 1 can be given. In this manner, the length of the rail 4 may appropriately be changed depending on ease of rotation of the splice roller 1, a magnitude of braking force that can be given by the brake 13, detection accuracy of the rotary encoder 25 and the like.

Incidentally, the brake 13 in the above embodiment is not a required component. By making a coefficient of friction of the bearing 17 fastened between the axis 18 and the pivotal supporting part 7 larger, for example, over-rotation due to inertia of the splice roller 1 may be prevented. In this case, by constructing the above embodiment in such a way that the splice roller 1 rotates only when the rail wheel 11 and the rail 4 are in contact, similar action and effects as those of the above embodiment can be achieved.

Also, the above embodiment is constructed so that the amount of rotation of the axis 18 is detected using the rotary encoder 25, but a means for detecting the amount of rotation of the splice roller 1 is arbitrary and, instead of the rotary encoder 25, for example, a proximity switch or the like may be used to detect the amount of rotation of the axis 18.

Also in the above embodiment, the clamp roller 2 is pivotally supported to freely rotate with respect to the clamp base 9, but depending on, for example, paper quality of the new web 23, the coefficient of friction between the new web 23 and the splice roller 1 and the like, a clamp roller securely attached to the clamp base 9 may also be used. That is, though it is preferable to fasten the new web 23 between two rollers to rewind the new web 23 without causing twist and bending, as long as the new web 23 can be rewound with out being exerted an excessive force, instead of the clamp roller 2, a clamp base whose surface is in contact with that of the splice roller 1 and fastens the new web 23 may also be used.

What is claimed is:

1. A paper splicing apparatus that carries out paper splicing to feed paper continuously by sticking a tip of a new web pulled out from a rolled web to an old web drawn out from another rolled web, comprising:

a first reciprocating member provided to freely reciprocate in a direction toward or away from a surface of the old web;

a second reciprocating member provided to freely reciprocate in the direction toward or away from the surface of the old web independently of said first reciprocating member;

a first roller pivotally supported to freely rotate with respect to said first reciprocating member; and a second roller pivotally supported to freely rotate with respect to said second reciprocating member for fastening the new web between said first roller and said second roller, wherein the second roller is arranged to press the new web directly against the first roller to sandwich the web between the first and second rollers and therefore fasten the new web therebetween.

2. The paper splicing apparatus according to claim 1 further comprising:

a rotating member that is mounted securely on said first roller and has a rotation surface that moves rotationally as said first roller rotates; and a member provided in rows that is in contact with the rotation surface of said rotating member and causes said rotating member to rotate as said first reciprocating member reciprocates.

3. A paper splicing apparatus that carries out paper splicing to feed paper continuously by sticking a tip of a new web pulled out from a rolled web to an old web drawn out from another rolled web, comprising:

a first reciprocating member provided to freely reciprocate in a direction toward or away from a surface of the old web;

a second reciprocating member provided to freely reciprocate in the direction toward or away from the surface of the old web independently of said first reciprocating member;

a first roller pivotally supported to freely rotate with respect to said first reciprocating member;

a second roller pivotally supported to freely rotate with respect to said second reciprocating member for fastening the new web between said first roller and said second roller;

a rotating member that is mounted securely on said first roller and has a rotation surface that moves rotationally as said first roller rotates;

a member provided in rows that is in contact with the rotation surface of said rotating member and causes said rotating member to rotate as said first reciprocating member reciprocates; and a brake member for constraining rotation of said rotating member with respect to said first reciprocating member.

4. The paper splicing apparatus according to claim 3 further comprising:

a rotation detecting means for detecting an amount of rotation of said first roller by said member provided in rows, wherein said brake member constrains rotation of said rotating member when the amount of rotation detected by said rotation detecting means becomes equal to or larger than a predetermined amount.

5. The paper splicing apparatus according to claim 4 wherein said member provided in rows is arranged more closely on the rolled web side of said fastened new web than a moving track of a central point of said first roller related to reciprocation of the first roller.

6. The paper splicing apparatus according to claim 3 wherein said member provided in rows is arranged more closely on the rolled web side of said fastened new web than a moving track of a central point of the first roller related to reciprocation of said first roller.

7. A paper splicing apparatus that carries out paper splicing to feed paper continuously by sticking a tip of a new web pulled out from a rolled web to an old web drawn out from another rolled web, comprising:

a first reciprocating member provided to freely reciprocate in a direction toward or away from a surface of the old web;

a second reciprocating member provided to freely reciprocate in the direction toward or away from the surface of the old web independently of said first reciprocating member;

a first roller pivotally supported to freely rotate with respect to said first reciprocating member;

a second roller pivotally supported on the second reciprocating member so as to be freely rotate with respect to said second reciprocating member and movable with the second reciprocating member toward a position wherein the new web can be clamped between said first roller and said second roller; and a brake member for constraining rotation of said rotating member with respect to said first reciprocating member.

* * * * *